US005834168A

United States Patent [19]

Evans et al.

[11] Patent Number: 5,834,168

[45] **Date of Patent: *Nov. 10, 1998**

[54] PHOTOGRAPHIC IMAGE-FORMING PROCESS

[75] Inventors: Gareth Bryn Evans, Potten End; Peter Jeffery Twist, Great Missenden, both of United Kingdom

[73] Assignee: Eastman Kodak Company, Rochester, N.Y.

[ * ] Notice: The term of this patent shall not extend beyond the expiration date of Pat. No. 5,741,631.

[21] Appl. No.: 780,279

[22] Filed: Jan. 9, 1997

[30] Foreign Application Priority Data

Jan. 10, 1996 [GB] United Kingdom ..... 9600408

[51] Int. Cl.[6] ..... G03C 5/395; G03C 7/44

[52] U.S. Cl. ..... 430/399; 430/465

[58] Field of Search ..... 430/399, 465

[56] References Cited

U.S. PATENT DOCUMENTS

| | | | |
|---|---|---|---|
| 5,324,624 | 6/1994 | Twist | 430/943 |
| 5,358,830 | 10/1994 | Twist | 430/943 |
| 5,376,509 | 12/1994 | Yoshimoto et al. | 430/465 |
| 5,387,499 | 2/1995 | Earle et al. | 430/373 |
| 5,405,732 | 4/1995 | Shimizu et al. | 430/465 |
| 5,436,118 | 7/1995 | Carli et al. | 430/400 |
| 5,556,736 | 9/1996 | Haraguchi et al. | 430/465 |

FOREIGN PATENT DOCUMENTS 0595312A 5/1994 European Pat. Off. .

*Primary Examiner*—Hoa Van Le
*Attorney, Agent, or Firm*—J. Lanny Tucker

[57] ABSTRACT

A process for the development of an imagewise exposed photographic material having at least one silver halide layer, comprises forming an image therein in a solution that contains a developing agent, that is replenished. The process is carried out in an apparatus comprising at least one processing tank in which the ratio of the tank volume to maximum area of material accommodatable therein is less than 20 $dm^3/m^2$. Substantially all replenishers are added as solids directly to said developer.

11 Claims, 1 Drawing Sheet

PHOTOGRAPHIC IMAGE-FORMING PROCESS

FIELD OF THE INVENTION

This invention relates to a photographic image-forming process.

BACKGROUND OF THE INVENTION

It is desirable to reduce the volume of chemicals added to processing solutions so as to reduce overflow from processes and hence reduce waste and pollution. It is also desirable to add chemicals in concentrated form, even as solids, so that transport and packaging costs can be minimized. However, the minimum practical limits of replenishment volume are set, not by the upper limits of concentration of chemicals added, but by other considerations such as the maximum tolerable concentrations of materials produced or released during processing.

Low volume processing tanks have been described which operate at rapid tank turn-over rates. U.S. Pat. No. 5,436,118 describes such tanks in combination with replenishment systems wherein chemicals are added in a concentrated liquid form.

Systems of largely solid chemical replenishment have been described for conventional color development processes in conventional developing tanks in which tablets of chemical mixtures are added to the tanks directly. Water is then added to control the overflow and hence the removal of undesirable chemicals from the tank.

The use of small volumes of replenisher results in variable sensitometric results, particularly when processors are working at less than full throughput or intermittently.

The problem to be solved is to provide the advantages of adding components in as concentrated a form as possible without the processing solutions undergoing undesirable loss of activity.

SUMMARY OF THE INVENTION

According to the present invention there is provided a process for the development of an imagewise exposed photographic material having at least one silver halide layer, said process comprising forming an image therein in a processing solution that contains a color developing agent, said solution being replenished by a replenisher, wherein said process being carried out in an apparatus comprising at least one processing tank in which the ratio of the tank volume to maximum area of material accommodatable therein is less than 20 $dm^3/m^2$, said replenisher being added as solids directly to said processing solution together with additional water which may contain a minor amount of replenisher chemicals, and wherein the average residence time of said processing solution in said processing tank is defined by the formula:

$$\text{Average residence time} = \frac{V \times 100 \times 3}{R \times T \times U \times 60} \quad (1)$$

where V is the volume of said processing tank (liters), R is the replenishment rate (liters/$m^2$), T is the transport speed ($m^2$/min) and U is the percent utilization as the percentage of a working day (8 hours) that the processor is running, and is less than the useful lifetime of said processing solution, said useful lifetime being the time at 35° C. for which the Dmax values for red, green and blue (or the silver image Dmax of a black-and-white material) remain at or above 80% of the value(s) produced by a freshly prepared solution.

The use of the low volume tank and the specified low residence time provides environmentally desirable minimal replenishment without suffering loss of activity of the processing solution or its replenishers in both conventional color development and redox amplification processes.

The faster tank turnover rate reduces the problem of biogrowth and chemical instability.

The lower tank volume results in lower wastage and solution volume needed to refill the tank, lower energy requirements to heat the solution and less sensitometric variability.

The use of solid replenishers without a low volume tank can lead to chemical instability, e.g., instability of phosphate buffers.

DETAILED DESCRIPTION OF THE INVENTION

Figure 1:
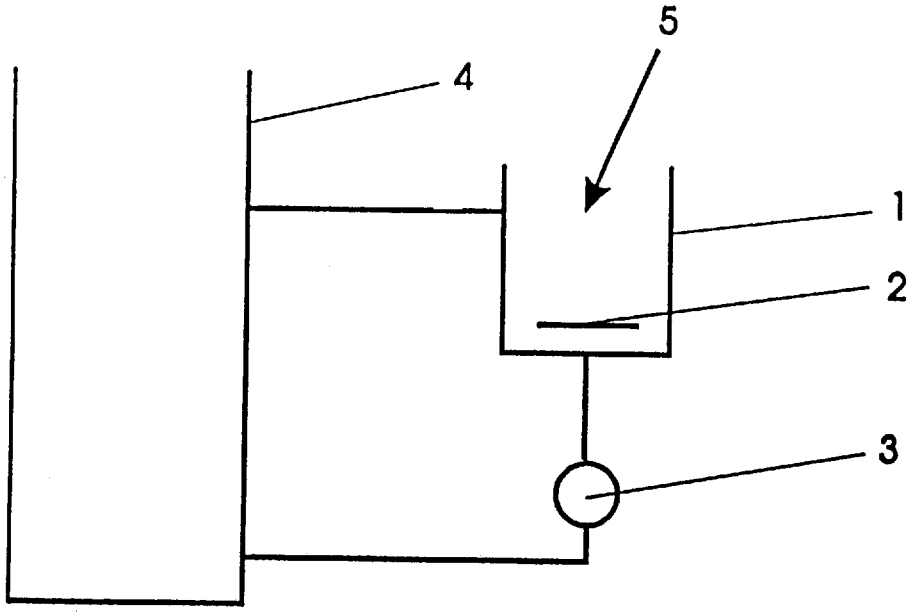
FIG. 1 is a schematic diagram showing the method of adding solids to a processing solution.

The photographic material may be a black-and-white or color material.

The developing solution may contain an antioxidant developing agent preservative. Preferably such antioxidants are solids. Examples of such solid antioxidants are an alkali metal sulfite, hydroxylamine may be in the form of a salt thereof such as hydroxylamine chloride, phosphate or, preferably, sulphate, or a substituted hydroxylamine. The substituted hydroxylamines may be alkyl or aryl substituted. Such alkyl and aryl being possibly further substituted with hydroxy, carboxy or sulfo groups, for example:

Diethylhydroxylamine, hydroxyethylethylhydroxylamine, or dipropylhydroxylamine preferably in the form of their hydrochloride or sulfate salt or disulfoethylhydroxylamine as the di-alkali metal salt, e.g., the dipotassium salt.

The material being processed may be a photographic film or paper material.

The material may comprise the emulsions, sensitizers, couplers, supports, layers, additives, etc. described in Research Disclosure, December 1978, Item 17643, published by Kenneth Mason Publications Ltd., Dudley Annex, 12*a* North Street, Emsworth, Hants P010 7DQ, U.K.

In one preferred embodiment the photographic material comprises a resin-coated paper support and at least one silver halide emulsion layer comprises more than 80 mol %, preferably more than 90 mol % silver chloride and are more preferably composed of substantially pure silver chloride.

In another preferred embodiment the material is a black-and-white material that may be a high contrast material for the graphic arts.

The pH of the developer may be in the range 9.5 to 12. Preferably the pH is in the range 10 to 12, and particularly from 10 to 11.7. For some applications the preferred pH is from 11.0 to 11.7, and preferably 11.0 to 11.4.

The developer solution may contain a buffering alkali material. Examples of such materials are alkali metal carbonates, silicates and phosphates, for example, sodium or potassium carbonates or phosphates. Additional alkali may also be present, e.g., an alkali metal hydroxide. The carbonates may be present in the solution in amounts of 10 to 60 g/l, preferably 15 to 45 g/l, and particularly 20 to 30 g/l as potassium carbonate, while the phosphates may be present in the solution in amounts of 20 to 80 g/l, preferably 25 to 65 g/l, and particularly 30 to 50 g/l as potassium phosphate.

A color developer solution may contain from 1 to 12 g/l of developing agent, and preferably from 3 to 8 g/l.

The color developing agent may be a p-phenylenediamine, for example:

4-amino-3-methyl-N,N-diethylaniline hydrochloride, 4-amino-3-methyl-N-ethyl-N-b-(methanesulfonamido)-ethylaniline sulfate hydrate, 4-amino-3-methyl-N-ethyl-N-b-hydroxyethylaniline sulfate, 4-amino-3-b-(methanesulfonamido)ethyl-N,N-diethylaniline hydrochloride, 4-amino-N-ethyl-N-(2-methoxy-ethyl)-m-toluidine di-p-toluene sulfonate, or 4-N-ethyl-N-(b-methanesulfonamidoethyl)-o-toluidine sesquisulfate.

The concentration range of the antioxidant component in a color developer is preferably from 0.5 to 10, and especially from 1 to 4 g/l (as hydroxylamine sulfate).

Examples of black-and-white developing agents that may be used include hydroquinones, p-aminophenols and pyrazolidinones of the formula:

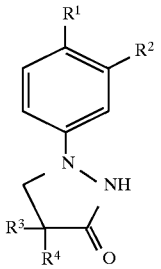

wherein $R^1$ to $R^4$ are alkyl or aryl groups that may be substituted with, for example, alkyl, halo, or hydroxy groups.

Examples of such black-and-white developing agents are hydroquinone, N-methyl-p-aminophenol, 1-phenyl-4-methyl-pyrazolidinone and 4-hydroxymethyl-4-methyl-1-phenylpyrazolidinone.

A black-and-white developer solution preferably contains from 0.2 to 12 g/l of one or more black-and-white developing agents. Typically hydroquinone will be used in a superadditive combination with a p-aminophenol or pyrazolidinone developing agent.

Black-and-white developers also contain an antioxidant developing agent preservative. Typically this is an alkali metal sulfite in concentration levels of 1–100 g/l, preferably 10–50 g/l (as sodium sulfite).

The color photographic materials can be single color materials or multicolor materials. Multicolor materials contain dye image-forming units sensitive to each of the three primary regions of the spectrum. Each unit can be comprised of a single emulsion layer or of multiple emulsion layers sensitive to a given region of the spectrum. The layers of the materials, including the layers of the image-forming units, can be arranged in various orders as known in the art.

A typical multicolor photographic material comprises a support bearing a yellow dye image-forming unit comprised of at least one blue-sensitive silver halide emulsion layer having associated therewith at least one yellow dye-forming coupler, and magenta and cyan dye image-forming units comprising at least one green- or red-sensitive silver halide emulsion layer having associated therewith at least one magenta or cyan dye-forming coupler respectively. The material can contain additional layers, such as filter layers.

As stated above, the process of the invention employs a tank of relatively small volume and in a preferred embodiment the ratio of the tank volume to maximum area of material accommodatable therein (i.e., maximum path length times width of material) is less than 20 $dm^3/m^2$, preferably less than 11 $dm^3/m^2$, and particularly less than 3 $dm^3/m^2$.

The process may be carried out in what is known in the art as a minilab. For example, the tank volume may be below 5 liters and sometimes below 3.0 liters conveniently in the range 1.5 to 2.5 liters and may be about 1 liter.

Solid replenishment is a convenient, accurate and consistent means of maintaining a developer and shows a particular advantage with low volume tanks and minimum replenishment rates. The replenishers contain components such as chelating agents and hydrogen peroxide that have traditionally been available as solutions. All these are available as solids, 1-hydroxyethylidene-1,1'-diphosphonic acid is available as the solid sodium salt (although it has to be converted to the potassium salt because the mixed calcium/sodium salt is prone to precipitate in developer solutions), diethyltriamine-pentaacetic acid is available as the solid free acid, "pentetic acid". Some substituted hydroxylamine antioxidants are liquids, e.g., diethylhydroxylamine but others are solids and these should be used in preference.

The replenishment is preferably accomplished entirely by the addition of solid replenishers plus water.

The material to be processed is conveniently passed through the tank and preferably the developer solution is recirculated through the tank at a rate of 0.1 to 10 tank volumes per minute. The preferred recirculation rate is from 0.5 to 8, especially from 1 to 5, and particularly from 2 to 4 tank volumes per minute.

The recirculation with or without replenishment may be carried out continuously or intermittently. In one method of working both can be carried out continuously while processing is in progress but not at all or intermittently when the tank is idle.

Replenishment may be carried out by introducing the required amount of replenisher into the solution in the recirculation system, preferably just before it enters the processing tank.

The shape and dimensions of the processing tank are preferably such that it holds the minimum amount of processing solution while still obtaining the required results. The tank is preferably one with fixed sides, the material being advanced therethrough by drive rollers. Preferably the photographic material passes through a thickness of solution of less then 11 mm, preferably less than 5 mm, and especially about 2 mm.

The shape of the tank is not critical but it may conveniently be in the shape of a shallow tray or, preferably U shaped.

It is preferred that the dimensions of the tank be chosen so that the width of the tank is the same as or only just wider than the width of the material being processed.

The total volume of the processing solution within the processing channel and recirculation system is relatively smaller as compared with prior art processes. In particular the total amount of processing solution in the entire processing system for a particular module is such that the total volume in the processing channel is at least 40% of the total volume of the processing solution in the entire system. Preferably the volume of the processing channel is at least about 50% of the total volume of the processing solution in the system.

In order to provide efficient flow of the processing solution through the opening or nozzles into the processing channel, it is desirable that the nozzles/opening that deliver the processing solution to the processing channel have a configuration in accordance with the following relationship:

$$0.6 \leqq F/A \leqq 23$$

where F is the flow rate of the solution through the nozzle in liters/minute and A is the cross sectional area of the nozzle provided in square centimeters.

Providing a nozzle in accordance with the foregoing relationship assures appropriate discharge of the processing solution against the photosensitive material.

Such low volume thin tank systems are described in more detail in the following references: U.S. Pat. No. 5,294,956; U.S. Pat. No. 5,179,404; U.S. Pat. No. 5,270,762; EP 559,025; EP 559,026; EP 559,027; WO92/10790; WO92/17819; WO93/04404; WO92/17370; WO91/19226; WO91/12567; WO9207302; WO93/00612; WO92/07301 and U.S. Pat. No. 5,436,118.

If the residence time of components of the developer solution is defined as the total time needed to reach one tank turnover (1TTO), then it is given by the following formula:

$$1TTO = \frac{V \times 100}{R \times T \times U} \quad (1)$$

where V is the volume of the processing tank (liter), R is the replenishment rate (liters/$m^2$), T is the transport speed ($m^2$/min) and U is the percent utilization as the percentage of a working day (8 hours) that the processor is running paper.

The processor is idle overnight for 16 hours and this time is part of the total standing time. In the case of conventional processing the chemical loss rates overnight will be lower than during a working day because the temperature is lower and the recirculation is switched off thus reducing aerial oxidation. However there will still be some extra losses overnight that must be taken into account. In the case of an RX developer/amplifier there will also be reduced loss overnight but since RX developer/amplifiers are generally less stable chemically than conventional developers, overnight standing could cause greater sensitometric deterioration. In order to account properly for overnight losses the concept of the average time to reach one tank turnover is proposed. This is defined as 24 hours divided by the number of tank turnovers possible during a working day of eight hours for a particular utilization, replenishment rate and tank volume. This works out simply to be 3 times the time to reach 1TTO during the working day. So equation (1) can be modified to account for this and to convert to hours instead of minutes to give equation (2) below.

$$\text{Average time to } 1TTO = \frac{V \times 100 \times 3}{R \times T \times U \times 60} \quad (2)$$

Table 1 below was constructed to show the relative times for different utilizations and for normal (0.161 liters/$m^2$ ) and low (0.033 liters/$m^2$) replenishment rates. This latter rate is about the minimum replenishment rate possible in order to maintain tank volume but to produce no overflow. If the volume of the developer tank is reduced to 1.80 liters instead of 22.414 liters, the residence times are correspondingly reduced for the period when the processor is working.

These volumes are those for a standard Kodak Model 52 paper processor (22.414 liters) and a modified Kodak Model 52 processor with a much smaller developer tank (1.80 liters). The word Kodak is a Registered Trade Mark.

The process will normally be carried out with recirculation. The volume of solution in the recirculation system is considered to be a part of the tank volume for the purpose of calculating the residence time.

TABLE 1

| | Residence Time (hours) | | | |
|---|---|---|---|---|
| | Large tank (22.4 1) | | Small tank (1.8 1) | |
| Utilization | low | normal | low | normal |
| 100% | 112.2 | 22.4 | 9 | 1.8 |
| 20% | 561.0 | 112.2 | 45 | 9 |
| 2% | 5610.0 | 1122.0 | 450 | 90 |

It can be seen from Table 1 that even at modest utilization rates of 20% the low replenishment rate gives a time of about 3 weeks. The lowest utilization rate of 2% although unusual in practice gives a time of about 30 weeks. Clearly, this illustrates the difficulty of maintaining a process in a conventional tank at the replenishment rates desired for improved environmental impact and economy. Even the most stable common process for color materials would not be reliable. Some of the common processes, particularly those with inferior antioxidant protection or poor pH buffering would be impractical at even modest utilization rates. However, with the low volume tank used in this illustration, even a processing solution whose useful life was as low as four days could be used even at the lowest utilization shown while taking full advantage of the use of solid replenishment.

In the present specification a developer solution is considered to be acceptable if the Dmax values are at or above 80% of the values of a freshly prepared solution and the useful lifetime of a solution is the time taken at 35° C. for the solution to deteriorate to less than 80% of the Dmax values of a fresh solution.

The Dmax values are measured by the well-known sensitometric methods using a pre-exposed test strip.

In the following examples the addition of solid materials to the processing tank can conveniently be added to the solution in the form of individual or composite pellets in the filter housing just before it passes through the filter. This is shown in FIG. 1 in which filter housing (1) contains a filter member (2) through which processing solution passes before being pumped by pump (3) into the processing tank (4). The solids and water are added directly to the filter housing as shown by arrow (5).

The following Examples are included for a better understanding of the invention.

EXAMPLE 1

A color paper developer was made to the formulation:

| | |
|---|---|
| $K_3AC5$ | 0.8 g/l |
| $K_2CO_3$ | 25 g/l |
| DEH · HCl | 6 g/l |
| Phorwite ™ REU | 2.3 g/l |
| Total KCl | 2.8 g/l |
| (2.7g/l comes from the DEH · HCl) | |
| KBr | 0.02 g/l |
| CD3 | 4.85 g/l |
| $Li_2SO_4$ | 2.7 g/l |
| pH | 10.12 |

where DEH is diethylhydroxylamine hydrochloride. This material can be replaced with 15 g/l of the di-potassium salt of di-sulfoethyl hydroxylamine if desired.

The solid addition rates and water to achieve an overall replenishment rate of 32 ml/m$^2$ are as follows:

| | |
|---|---|
| $K_3AC_5$ | 15.9 mg/m$^2$ |
| $K_2CO_3$ | 0.8 g/m$^2$ |
| DEH · HCl | 0.7 g/m$^2$ |
| Phorwhite REU | 0.07 g/m$^2$ |
| CD3 | 0.54 g/m$^2$ |
| $LiSO_4$ | 0.086 g/m$^2$ |
| KOH | 0.25 g/m$^2$ |
| water | 32 ml/m$^2$ |

The volume taken-up by the solids is approximately equal to the water evaporation rate of the processor.

EXAMPLE 2

A black and white developer was made to the formulation:

| | |
|---|---|
| Sodium sulfite | 16 g/l |
| N-methyl-p-aminophenol sulfate | 1.45 g/l |
| Hydroquinone | 2.9 g/l |
| Quadraphos ™ | 1.29 g/l |
| $Na_2CO_3$ | 25 g/l |

where Quadraphos is tetrasodium pyrophosphate.

The solid addition rates for an overall replenishment rate of 320 ml/m$^2$ and a silver bromide coating containing 1.08 g/m$^2$ of silver at an average exposure of 25% of Dmax, are as follows:

| | |
|---|---|
| Sodium sulfite | 5.69 g/m$^2$ |
| N-methyl-p-aminophenol sulfate | 0.46 g/m$^2$ |
| Hydroquinone | 1.06 g/m$^2$ |
| Quadraphos | 0.41 g/m$^2$ |
| $Na_2CO_3$ | 8.0 g/m$^2$ |
| Water | 320 ml/m$^2$ |

EXAMPLE 3

A black and white developer was made to the formulation:

| | |
|---|---|
| Sodium sulfite | 16 g/l |
| N-methyl-p-aminophenol sulfate | 1.45 g/l |
| Hydroquinone | 2.9 g/l |
| KBr | 3.72 g/l |
| Quadraphos ™ | 1.29 g/l |
| $Na_2CO_3$ | 25 g/l |

The solid addition rates for an overall replenishment rate of 80 ml/m$^2$ and a silver bromide coating containing 1.08 g/m$^2$ of silver at an average exposure of 25% of Dmax, are as follows;

| | |
|---|---|
| Sodium sulfite | 1.95 g/m$^2$ |
| Hydroquinone | 0.39 g/m$^2$ |
| Quadraphos | 0.14 g/m$^2$ |
| $Na_2CO_3$ | 2.5 g/m$^2$ |
| Water | 80 ml/m$^2$ |

The invention has been described in detail with particular reference to preferred embodiments thereof, but it will be understood that variations and modifications can be effected within the spirit and scope of the invention.

We claim:

1. A process for the development of an imagewise exposed photographic material having at least one silver halide layer, said process comprising forming an image therein in a processing solution that contains a color developing agent, said solution being replenished by a replenisher, wherein said process being carried out in an apparatus comprising at least one processing tank in which the ratio of the tank volume to maximum area of material accommodatable therein is less than 20 dm$^3$/m$^2$, said replenisher being added as solids directly to said processing solution together with additional water which may contain a minor amount of replenisher chemicals, and wherein the average residence time of said processing solution in said processing tank is defined by the formula:

$$\text{Average residence time} = \frac{V \times 100 \times 3}{R \times T \times U \times 60} \quad (1)$$

where V is the volume of said processing tank (liters), R is the replenishment rate (liters/m$^2$), T is the transport speed (m$^2$/min) and U is the percent utilization as the percentage of a working day (8 hours) that the processor is running, and is less than the useful lifetime of said processing solution, said useful lifetime being the time for which the Dmax values for red, green and blue (or the silver image Dmax of a black-and-white material) remain at or above 80% of the value(s) produced by a freshly prepared solution.

2. The process of claim 1 wherein the ratio of the tank volume to maximum area of material accommodatable therein is less than 11 dm$^3$/m$^2$.

3. The process of claim 1 wherein said processing solution is a color developer solution containing an antioxidant as a developing agent preservative.

4. The process of claim 1 wherein said processing solution contains from 1 to 12 g/l of color developing agent.

5. The process of claim 3 in which the antioxidant is a hydroxylamine salt or a solid substituted hydroxylamine.

6. The process of claim 1 comprising forming a silver image in a black-and-white developer solution.

7. The process of claim 6 wherein said processing solution contains an antioxidant that is an alkali metal sulfite.

8. The process of claim 6 wherein said black-and-white developer solution contains from 0.2 to 12 g/l of one or more black-and-white developing agents.

9. The process of claim 1 wherein said processing solution is replenished at a replenishment rate of from less than 215 ml/m$^2$ down to the rate necessary to maintain tank volume but produce no overflow.

10. The method of claim 1 wherein said processing solution has a pH of from 10 to 11.7.

11. The method of claim 1 wherein said processing solution comprises a carbonate buffer in an amount of from 10 to 60 g/l, or a phosphate buffer in an amount of from 20 to 80 g/l.

* * * * *